US005258686A

United States Patent [19]

Segoshi et al.

[11] Patent Number: 5,258,686

[45] Date of Patent: Nov. 2, 1993

[54] AUTOMOTIVE LAMP DEVICE WITH ELECTROMAGNETIC SHIELDING

[75] Inventors: Toru Segoshi; Takashi Ashida, both of Kanagawa, Japan

[73] Assignee: Nissan Motor Company, Ltd., Japan

[21] Appl. No.: 681,676

[22] Filed: Apr. 8, 1991

[30] Foreign Application Priority Data

Apr. 20, 1990 [JP] Japan ..... 2-104416

[51] Int. Cl.[5] ..... H01J 5/16

[52] U.S. Cl. ..... 313/313; 313/112; 313/111; 313/117; 362/61; 362/293; 359/582; 359/585

[58] Field of Search ..... 313/313, 355, 111, 112, 313/113, 110, 117; 362/293, 61, 80; 315/85; 359/484, 485, 580–582

[56] References Cited

U.S. PATENT DOCUMENTS

| | | | |
|---|---|---|---|
| 3,007,160 | 10/1961 | Halpern | 359/582 |
| 4,642,514 | 2/1987 | English et al. | 313/110 |
| 4,766,526 | 8/1988 | Morimoto et al. | 362/293 |
| 4,811,179 | 3/1989 | Komatsu et al. | 362/293 |

FOREIGN PATENT DOCUMENTS

| | | | |
|---|---|---|---|
| 0132368 | 10/1979 | Japan | 315/85 |
| 61-259401 | 11/1986 | Japan . | |

OTHER PUBLICATIONS

Service Manual, vol. 538, issued by Nissan Motor Co., Ltd. Aug. 1987.

*Primary Examiner*—Donald J. Yusko
*Assistant Examiner*—Michael Horabik
*Attorney, Agent, or Firm*—Lowe, Price, LeBlanc & Becker

[57] ABSTRACT

An automotive lamp device includes a metal lamp housing having an opening for passing light therethrough, an electric-discharge lamp accommodated in the lamp housing to provide a required amount of light to be emitted by the lamp device, a lens having a series of modified prisms or ridges that bend the light beam generated by the discharge lamp into a desired pattern, a finisher disposed in an inner perimeter section other than a main lens section of the lens, for preventing propagation of the light beams through a section other than the main lens section of the lens. The finisher is made of metal and, in addition, electromagnetic shielding is employed in the lens for preventing undesirable electromagnetic radiation noise generated by the discharge lamp from leaking through the lens to the exterior of the lamp housing, while allowing the required amount of light to pass through the lens.

8 Claims, 1 Drawing Sheet

FIG. 1
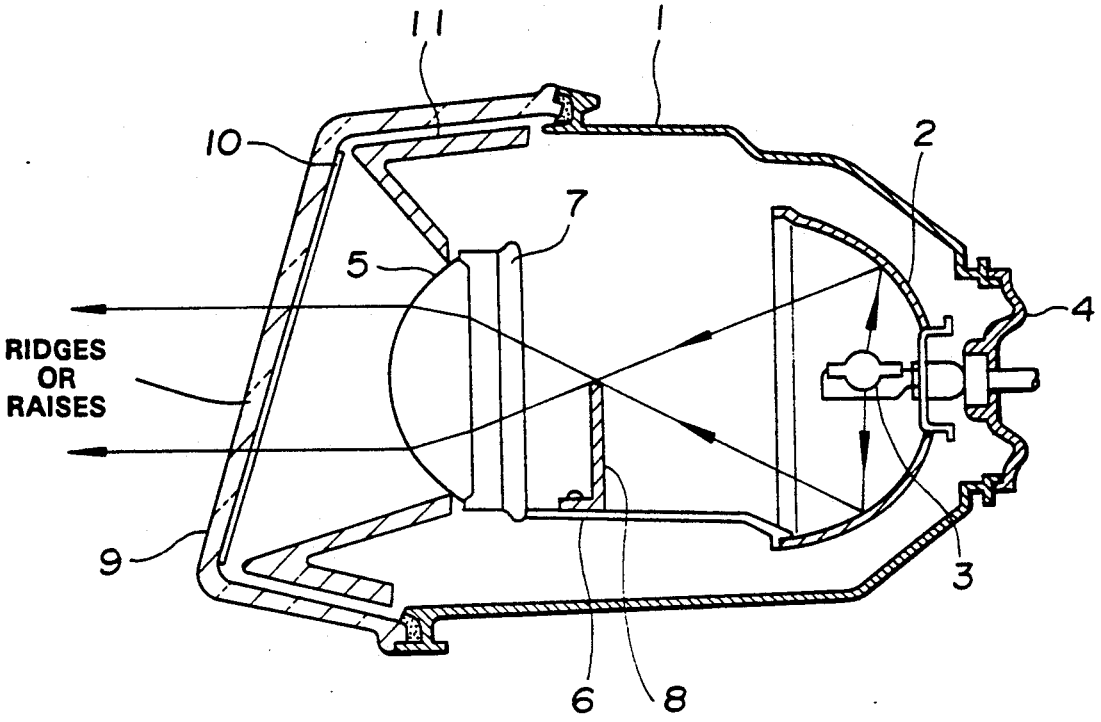
FIG. 2
FIG. 3
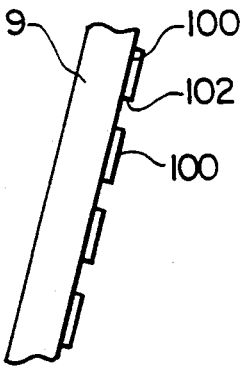
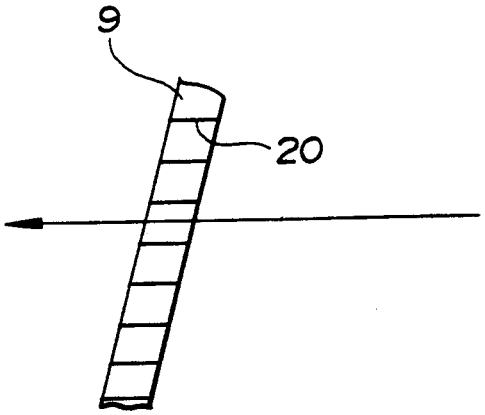

AUTOMOTIVE LAMP DEVICE WITH ELECTROMAGNETIC SHIELDING

BACKGROUND OF THE INVENTION

1. Field of the Invention

The present invention relates to a lamp device employing an electric-discharge lamp particularly adapted for mounting on automotive vehicles, and more specifically to a projector type automotive headlamp device which is capable of preventing undesirable electromagnetic waves generated by an electric-discharge lamp employed therein from being discharged outside the headlamp.

2. Description of the Prior Art

Recently, there have been proposed and developed various projector type automotive lamp devices having an electric-discharge bulb, such as a projector type headlamp, a projector type fog lamp, and the like, having superior light-distribution characteristics, which are applicable in high-grade automotive vehicles. One such projector type automotive headlamp has been disclosed in a SERVICE MANUAL Vol. 538 issued by Nissan Motor Co., Ltd. on August, 1987.

Such a conventional projector type headlamp assembly traditionally includes a metal lamp housing having a front opening for passing a light beam and an outer lens having a series of modified prisms or ridges that bend the light rays into a desired pattern. The outer lens is provided in the front end of the lamp housing to hermetically cover the front opening. The projector type headlamp assembly includes a lamp sub-assembly which is disposed in the lamp housing and constructed by a paraboloidal reflector and an electric discharge lamp located at the focal point of the reflector. The projector type headlamp assembly also includes an inner lens serving as a converging lens for converging and emitting light beams reflected from the reflector and those transmitted directly form the discharge lamp. The converted light beams are projected through the outer lens in the forward direction of the vehicle. An inner finisher or inner panel is disposed between the outer periphery of the inner converging lens and an outer peripheral section other than the front lens section of the outer lens, for preventing light beams created by the discharge lamp from transmitting through an undesirable region other than the front lens section of the outer lens and for serving as a blind member obstructing a visual field to the interior of the housing. A shade member is also provided between the inner converging lens and the lamp sub-assembly, for defining and projecting a predetermined shadow in the forward direction of the vehicle in conjunction with the inner converging lens, thereby preventing undesirable leakage of light beams above the required headlight emitting level. As set forth above, in the prior art projector type headlamp devices, the combination of the inner converging lens and the shade member provides superior light-distribution characteristics for a dim, or low beam headlight.

Furthermore, Japanese Patent First Publication (Tokkai) Showa 61-259401 discloses a two-filament type headlamp including an electric-discharge bulb and a front lens being comprised of a plurality of lens segments respectively having different transmittance.

However, in the previously described conventional lamp devices employing an electric-discharge bulb, there is a problem that undesirable electromagnetic waves generated by the electric-discharge lamp (bulb) pass through the outer lens and are discharged outside of the lamp housing. As is generally known, such electromagnetic waves are harmful to various electronic parts, for example a large-scale integration (LSI) device employed in the vehicle so as to provide various control operations, and further causes generation of electromagnetic noise.

SUMMARY OF THE INVENTION

It is therefore, in view of the above disadvantages, an object of the present invention to provide a lamp device employing an electric-discharge lamp which can prevent electromagnetic radiation noise created by the discharge lamp from leaking outside of the headlamp housing, while insuring a required amount of light is emitted therefrom.

In order to accomplish the aforementioned and other objects, a lamp device for an automotive vehicle comprises a metal lamp housing having an opening for passing light therethrough, an electric-discharge lamp accommodated in the lamp housing to provide a required amount of light to be emitted by the lamp device, and a lens having a series of modified prisms or ridges that bend the light beam generated by the discharge lamp into a desired pattern. The lens is mounted on the lamp housing to hermetically cover the opening of the lamp housing. A finisher is also disposed in an outer peripheral section other than a main lens section of the lens, for preventing propagation of the light beams through a section other than the main section of the lens. The finisher is made of metal and, in addition, electromagnetic shielding is employed in the lens for preventing electromagnetic radiation noise generated by the discharge lamp from leaking through the lens to the exterior of the lamp housing, while allowing the required amount of light to pass through the lens.

The shielding provides a high electromagnetic shielding effect in conjunction with the metal lamp housing and the metal finisher. The shielding may comprise a thin metal coated film formed on the inner wall of the lens in a complicated geometrical pattern by means of vacuum deposition so as to define a plurality of optical slits therein. Preferably, the thin metal coated film comprises a thin aluminum coated film. Alternatively, the shielding may comprise a plurality of thin metal plates buried in the main lens section of the lens in such a manner that the thin metal plates are spaced apart from each other and each plane of the thin metal plates is arranged in parallel with a propagating direction of the light beam projected to the lens, so as to define a plurality of optical slits therein.

According to another aspect of the invention, a projector type automotive headlamp device employing an electric-discharge.lamp comprises a metal lamp housing having a front opening for passing light beam therethrough, an electric-discharge lamp accommodated in the lamp housing to provide a required amount of light to be emitted by the headlamp device, an inner lens arranged forwardly of the discharge lamp for converging light beams from the discharge lamp, and an outer lens having a series of modified prisms or ridges that bend the light beams passed through the inner lens into a desired pattern. The outer lens is mounted on the front end of the lamp housing to hermetically cover the front opening. A finisher is disposed between an outer periphery of the inner lens and an inner perimeter section other than a main lens section of the outer lens, for preventing propagation of light through a section other than the main lens section of the outer lens. The finisher is made of metal and electromagnetic shielding is employed in the outer lens for preventing electromagnetic radiation noise generated by the discharge lamp from leaking through the outer lens to the exterior of the lamp housing, while allowing the required amount of light through the outer lens via the inner lens.

BRIEF DESCRIPTION OF THE DRAWINGS

FIG. 1 is a sectional view illustrating a projector type automotive headlamp assembly according to the present invention.

FIG. 2 is a partial section illustrating a variation of an electromagnetic shielding employed in the projector type automotive headlamp assembly shown in FIG. 1; and FIG. 3 is a partial sectional view illustrating a further variation of electromagnetic shielding.

DESCRIPTION OF THE PREFERRED EMBODIMENTS

Referring now to the drawings, particularly to FIG. 1, a projector type headlamp device according to the present invention includes a metal lamp housing 1 having a front opening for passing a light beam therethrough and an outer lens 9 having a series of modified prisms or ridges that bend the light beams into a desired pattern. The outer lens 9 is provided in the front end of the lamp housing 1 to hermetically cover the front opening of the housing in a water-tight fashion.

The projector type headlamp assembly includes a lamp sub-assembly constructed of a paraboloidal reflector 2 and an electric-discharge lamp 3 located at a focal point of the reflector 2. For example, the reflector 2 may consist of a thin aluminum film glass reflector coated by vacuum deposition. The lamp sub-assembly is firmly received by a supporting member 4 detachably assembled in the rear end of the housing 1. The supporting member 4 is generally made of metal.

The projector type headlamp assembly also includes an inner lens 5 serving as a converging lens for converging and emitting light beams reflected from the reflector 2 and directly transmitted from the discharge lamp 3. The inner converging lens 5 is arranged in alignment with the optical axis of the reflector 2, and the converged light beams are thus projected through the front lens section of the outer lens 9 in the forward direction of the vehicle. The inner lens 5 is firmly fitted and held in a lens holder 7 through the outer periphery thereof. Although not clearly shown, the lamp holder 7 is firmly fixed on the inner wall of the housing 1. The reflector 2 and the inner lens 5 are spaced apart from each other at a predetermined interval by means of a spacer 6. As seen in FIG. 1, the lowermost portion of the reflector 2 and the lowermost portion of the lens holder 7 are interconnected by the spacer 6. An inner finisher or inner panel 11 is disposed between the outer periphery of the inner converging lens 5 and an inner perimeter section other than the front lens section of the outer lens 9, for preventing light beams created by the discharge lamp from being transmitted through a section other than the front lens section of the outer lens 9 and for serving as a blind member obstructing a visual field to the interior of the housing 1.

A shade member 8 is provided between the inner converging lens 5 and the lamp sub-assembly, for defining and projecting a predetermined shadow in the forward direction of the vehicle in conjunction with the inner converging lens 5 and thereby assuring cut off of undesirable leakage of light beams above a required headlight emitting level. As shown in FIG. 1, the shade member 8 is fixed on the spacer 6 in a desirable position by rivetting, in a manner so as to insure the previously noted predetermined shadow. The above mentioned construction of the headlamp assembly of the present embodiment is similar to the conventional projector type headlamp assembly as described in the Description of the Prior Art.

The projector type headlamp assembly of the present invention includes electromagnetic shielding 10 formed on the inner wall of the front lens section of the outer lens 9, having a series of modified prisms or ridges. Although it is not clearly seen in FIG. 1, the shielding 10 is formed on the inner wall of the outer lens 9 in a complicated geometrical pattern. The shielding 10 may comprise a thin metal coated film 100 (as depicted in FIG. 3) (preferably a thin aluminum coated film) formed on the inner wall of the outer lens 9 in a complicated geometrical pattern by means of vacuum, deposition so as to define a plurality of optical slits 102 therein, with the result that a required amount of light can be emitted through the outer lens 9 into the forward direction of the vehicle and in addition electromagnetic radiation noise generated by the discharge bulb 3 cannot leak to the exterior of the lamp housing 1. That is, the shielding 10 serves as a filtering element for preventing passage of electromagnetic radiation noise therethrough and for allowing a required amount of light to pass therethrough. Furthermore, in the headlamp assembly according to the invention, the finisher 11, as well as the lamp housing 1 and the supporting member 4, are made of metal.

In the aforementioned construction of the preferred embodiment of the headlamp device according to the invention, reflected light reflected by the reflector 2 and non-reflected light directly transmitted from the discharge lamp 3 are emitted in the forward direction of the vehicle through the shade member 8, the inner lens 5, the electromagnetic shielding 10, and the outer lens 9, in that order. As set forth above, when the light beams pass through the shielding 10, the shielding acts in conjunction with the housing 1, the supporting member 4, and the finisher 11, respectively made of metal, in such a manner as to allow passing of a required amount of light and to prevent electromagnetic radiation noise generated by the discharge lamp 3 from leaking to the exterior of the lamp housing 1.

Referring now to FIG. 2, the shielding 10 may comprise a plurality of thin metal plates 20 buried in the front lens section of the outer lens 9 such that these thin metal plates are spaced apart from each other at a predetermined interval and each plane of the metal plates 20 is arranged in parallel with a propagating direction of the light beam projected through the inner converging lens 5 to the outer lens 9, so as to define a plurality of optical slits between the adjacent thin metal plates 20. In such a variation of the shielding 10 as shown in FIG. 2, since the shielding 10 employing the thin metal plates 20 functions as an effective filtering element for filtering out undesirable electromagnetic waves discharged from the discharge lamp 3, the previously described optimal electromagnetic shielding effect can be obtained and in addition a required amount of light can be assuringly propagated through optical slits defined between the adjacent thin metal plates 20 towards the exterior of the lamp housing 1.

As will be appreciated from the above, electromagnetic shielding employed in a lamp assembly for automotive vehicles according to the invention, can effectively avoid leakage of electromagnetic radiation noise from the discharge lamp 3 towards the exterior of the housing 1 and allow a required amount of light to be emitted therethrough in the forward direction of the vehicle.

In the previously noted embodiments, although electromagnetic shielding according to the invention is employed in a projector type automotive headlamp assembly, such a shielding may be applied for another automotive lamps, such as automotive fog lamps, for example, which employ an electric-discharge bulb therein.

While the foregoing is a description of the preferred embodiments for carrying out the invention, it will be understood that the invention is not limited to the particular embodiments shown and described herein, but may include variations and modifications without departing from the scope or spirit of this invention as described by the following claims.

What is claimed is:

1. A lamp device for an automotive vehicle, comprising:

a metal lamp housing having an opening for passing light therethrough;

an electric-discharge lamp mounted in said lamp housing to provide light emitted by said lamp device;

a lens having a series of modified prisms or ridges that bend the light generated by said discharge lamp into a desired pattern, said lens being mounted on said lamp housing to hermetically cover the opening of said lamp housing;

a finisher made of metal, disposed in an inner perimeter section other than a main lens section of said lens, for preventing propagation of light through a section other than the main lens section of said lens;

said lens including an electromagnetic shielding for preventing electromagnetic radiation noise generated by said discharge lamp from leaking through said lens to the exterior of said lamp housing, while allowing a required amount of light to pass through said lens; and said electromagnetic shielding comprising a thin metal coated film formed on the inner wall of said lens in a predetermined geometrical pattern by means of vacuum deposition so as to define a plurality of optical slits therein.

2. The lamp device as set forth in claim 1, wherein said electromagnetic shielding provides a high electromagnetic shielding effect in cooperation with said metal lamp housing and said metal finisher.

3. The lamp device as set forth in claim 1 wherein said thin metal coated film comprises a thin aluminum coated film.

4. A lamp device for an automotive vehicle, comprising:

a metal lamp housing having an opening for passing light therethrough;

an electric-discharge lamp mounted in said lamp housing to provide light emitted by said lamp device;

a lens having a series of modified prisms or ridges that bend the light generated by said discharge lamp into a desired pattern, said lens being mounted on said lamp housing to hermetically cover the opening of said lamp housing;

a finisher made of metal, disposed in an inner perimeter section other than a main lens section of said lens, for preventing propagation of light through a section other than the main lens section of said lens;

said lens including an electromagnetic shielding for preventing electromagnetic radiation noise generated by said discharge lamp form leaking through said lens to the exterior of said lamp housing, while allowing a required amount of light to pass through said lens; and said electromagnetic shielding comprises a plurality of thin metal plates buried in the main lens section of said lens in such a manner that the thin metal plates are spaced apart from each other and a plane of each of said thin metal plates is arranged in parallel with a propagating direction of the light projected through said lens.

5. A projector type automotive headlamp device employing an electric-discharge lamp comprising:

a metal lamp housing having a front opening for passing light therethrough;

an electric-discharge lamp mounted in said lamp housing to provide light emitted by said headlamp device;

an inner lens arranged forwardly of said discharge lamp, for converging light form said discharge lamp;

an outer lens having a series of modified prisms or ridges that bend the light passed through said inner lends into a desired pattern, said outer lends being mounted on the front end of said lamp housing to hermetically cover the front opening of said lamp housing in a water-tight fashion;

a finisher made of metal disposed between an outer periphery of said inner lens and an inner perimeter section other than a main lens section of said outer lens, for preventing propagation of light through a section other than the main lens section of said outer lens;

said outer lens including an electromagnetic shielding for preventing electromagnetic radiation noise generated by said discharge lamp from leaking through said outer lens to the exterior of said lamp housing, while allowing a required amount of light through said outer lens via said inner lens;

said electromagnetic shield comprising a thin metal coated film formed on the inner wall of said outer lens i a predetermined geometrical pattern by means of vacuum deposition so as to define a plurality of optical slits therein.

6. The projector type headlamp device as set forth in claim 5, wherein said electromagnetic shielding cooperates with said metal lamp housing and said metal finisher to provide a high electromagnetic shielding effect.

7. The projector type headlamp device as set forth in claim 5, wherein said thin metal coated film comprise a thin aluminum coated film.

8. A projector type automotive headlamp device employing an electric-discharge lamp comprising;

a metal lamp housing having a front opening for passing light therethrough;

an electric-discharge lamp mounted in said lamp housing to provide light emitted by said headlamp device;

an inner lens arranged forwardly of said discharge lamp, for converging light form said discharge lamp;

an outer lens having a series of modified prisms or ridges that bend the light passed through said inner lends into a desired pattern, said outer lends being mounted on the front end of said lamp housing to hermetically cover the front opening of said lamp housing in a water-tight fashion;

a finisher made of metal disposed between an outer periphery of said inner lens and an inner perimeter section other than a main lens section of said outer lens, for preventing propagation of light through a section other than the main lens section of said outer lens;

said outer lens including an electromagnetic shielding for preventing electromagnetic radiation noise generated by said discharge lamp from leaking through said outer lens to the exterior of said lamp housing, while allowing a required amount of light through said outer lens via said inner lens;

said electromagnetic shielding comprises a plurality of thin metal plates buried in the main lens section of said outer lens in such a manner that the thin metal plates are spaced apart from each other and a plane of each of said thin metal plates is arranged in parallel with a propagating direction of the light projected through said inner lens to said outer lens.

* * * * *